US007965271B2

(12) United States Patent
Fan et al.

(10) Patent No.: US 7,965,271 B2
(45) Date of Patent: Jun. 21, 2011

(54) LIQUID CRYSTAL DISPLAY DRIVING CIRCUIT AND METHOD THEREOF

(75) Inventors: Wen-Teng Fan, Tainan County (TW); Chien-Ru Chen, Tainan County (TW); Ying-Lieh Chen, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 747 days.

(21) Appl. No.: 11/752,586

(22) Filed: May 23, 2007

(65) Prior Publication Data

US 2008/0291147 A1 Nov. 27, 2008

(51) Int. Cl.
*G09G 3/36* (2006.01)

(52) U.S. Cl. ..... 345/98

(58) Field of Classification Search ..... 345/98, 345/99, 100

See application file for complete search history.

(56) References Cited

U.S. PATENT DOCUMENTS

| | | | | |
|---|---|---|---|---|
| 5,801,674 | A * | 9/1998 | Shimizu | 345/103 |
| 7,629,956 | B2 * | 12/2009 | Jang et al. | 345/99 |
| 2003/0193461 | A1 * | 10/2003 | Katagawa | 345/87 |
| 2005/0264546 | A1 * | 12/2005 | Chou et al. | 345/204 |
| 2005/0285842 | A1 * | 12/2005 | Kang et al. | 345/103 |
| 2006/0001636 | A1 * | 1/2006 | Okutani | 345/100 |
| 2006/0139291 | A1 * | 6/2006 | Cho et al. | 345/100 |
| 2007/0216630 | A1 * | 9/2007 | Liao | 345/100 |

* cited by examiner

*Primary Examiner* — Chanh Nguyen
*Assistant Examiner* — Kwang-Su Yang

(57) ABSTRACT

The present invention provides a liquid crystal display comprising a display panel, a plurality of gate drivers sequentially enabling rows of pixels of the display panel, a plurality of source drivers outputting a plurality of driving signals to the enabled row of the pixels of the display panel, and a timing controller outputting each of a plurality of start pulses to all the source drivers and sequentially enabling the source drivers so that each source driver respectively receives one of the start pulses, wherein each of the source drivers latch a plurality of image signals when receiving one of the start pulses.

21 Claims, 5 Drawing Sheets

LIQUID CRYSTAL DISPLAY DRIVING CIRCUIT AND METHOD THEREOF

FIELD OF THE INVENTION

The present invention relates to a drive circuit, and in particular, a drive circuit for a display such as a liquid crystal display.

BACKGROUND OF THE INVENTION

FIG. 1 is a circuit diagram showing a drive circuit of a display. The drive circuit includes eight source drivers 103A~103H connected to source lines 113, and four gate drivers 106 connected to the gate lines 116. The source lines 113 and gate lines 116 are formed in an LCD panel 105, and pixels having a TFT (not shown) as a switching device are arranged at the intersections thereof.

Clock signals or the like are transmitted in parallel to the gate drivers 106 from the control circuit 101, and clock signals, digital image data signals, latch signals and others are transmitted to the source drivers 103A~103H from the control circuit 101 to control each of the source drivers.

On the other hand, a start pulse signal (SP) is transmitted to only the first source driver 103A at the first stage. After the first source driver 103A receives the image data, the start pulse signal is transferred to the second source driver 103B at the next stage from the first source driver 103A. Then, the second source driver 103B operates in the same manner as that of the first source driver 103A. Thus, as shown by the arrows in FIG. 1, the start pulse signal is transferred from first source driver 103A to the eighth source driver 103H.

FIG. 2 is a timing chart showing signals inputted into the source drivers in the circuit of the display unit having source drivers that are cascade-connected to each other as shown in FIG. 1. Clock signal (CLK) and digital image data signals (D00 to Dxx) are inputted into the source drivers 103A~103H. The start pulse signal (SP) illustrated in the timing chart is inputted into the first source driver 103A at the first stage. The first source driver 103A starts to receive the digital image data two clocks after the falling edge of the start pulse. After the first source driver 103A receives the digital image data from the control circuit 101, the first source driver 103A provides a start pulse signal ($P_{103A\ to\ 103B}$) to enable the second source driver 103B.

In a traditional RSDS interface, the start pulse signal is a TTL signal. The impedance of the printed circuit board in which the start pulse signal line is built retards the transmission of the start pulse signal (SP) from the control circuit to the source drivers, which results in a longer time for the start pulse signal (SP) to be transferred to the source drivers. Therefore, the start of the source drivers and the receiving of the digital image data signals may be asynchronous. Moreover, when the frequency of the clock signal is increased, the source driver will start to receive the image data more clocks after the falling edge of the start pulse since the clock period is decreased.

Therefore, a new structure that may resolve the foregoing problem is required.

SUMMARY OF THE INVENTION

Therefore, it is the main purpose of the present invention to provide a drive circuit in which the transfer of the start pulse signal to the source drivers matches the transfer of the image data to the source drivers.

According to a preferred embodiment, a liquid crystal display is provided. The liquid crystal display comprises a display panel, a plurality of gate drivers sequentially enabling rows of pixels of the display panel, a plurality of source drivers outputting a plurality of driving signals to the enabled row of the pixels of the display panel, and a timing controller outputting each of a plurality of start pulses to all the source drivers and sequentially enabling the source drivers so that each source driver respectively receives one of the start pulses, wherein each of the source drivers latch a plurality of image signals when receiving one of the start pulses.

According to an embodiment, each of the source drivers is enabled when receiving an enable signal and the enable signal is transferred among the source drivers one by one.

According to an embodiment, the enable signal is a TTL signal and the start pulse is an RSDS signal.

According to an embodiment, the timing controller further delivers a clock signal to the source drivers. The pulse width of the enable signal is equal to one period of the clock signal and the pulse width of each of the start pulses is equal to one period of the clock signal.

In another embodiment, the present invention provides a method for delivering image signals to source drivers of a liquid crystal display, the method comprises outputting each of a plurality of start pulses to all the source drivers, and sequentially enabling the source drivers (102)so that each source driver respectively receives one of the start pulses, wherein each the source drivers latch the image signals when receiving one of the start pulses.

According to an embodiment, a TTL signal is used to enable the column drivers.

According to an embodiment, each of the start pulses is an RSDS signal.

According to an embodiment, the method further comprises to output a clock signal to the source drivers. Each of the source drivers latches the image signals upon the fourth falling edge of the clock signal after receiving one of the start pulses.

In another embodiment, the present invention further provides a driving circuit comprising a first input terminal, electrically coupled to an enable signal, a second input terminal, electrically coupled to a start pulse signal and means for receiving a plurality of image signals in response to a pulse of the start pulse signal following the enable signal.

Accordingly, an additional enabling signal is sued to enable the source drivers to receive corresponding start pulses. Therefore, the time between the input of the start pulse signals and the operation of the source drivers for receiving the image data may be reliably secured.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein.

DETAILED DESCRIPTION OF THE PREFERRED EMBODIMENT

Figure 1:
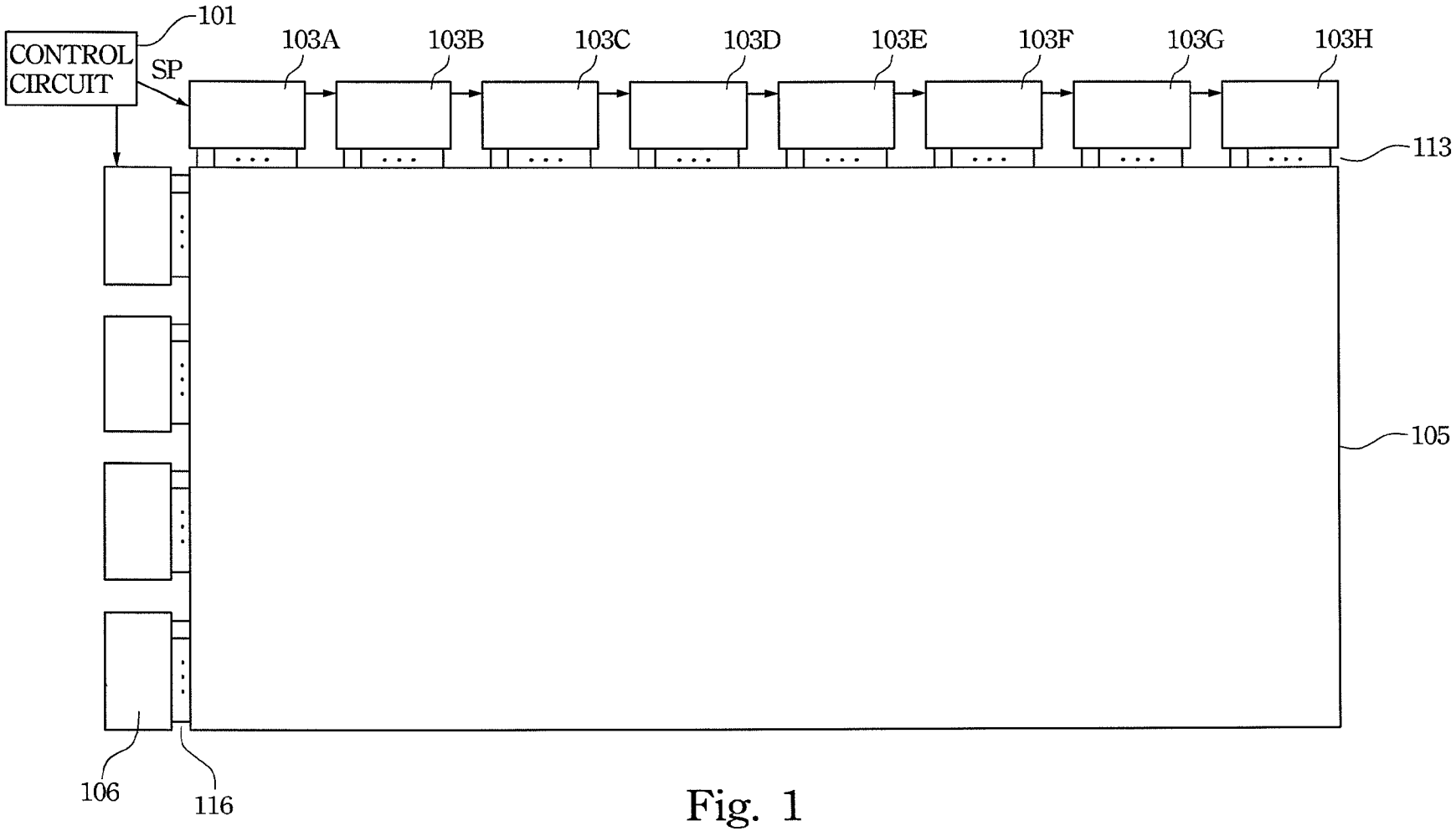
Fig. 1 (PRIOR ART)
FIG. 1 is a schematic diagram of a plan view illustrating a flat panel display of prior art.
Figure 2:
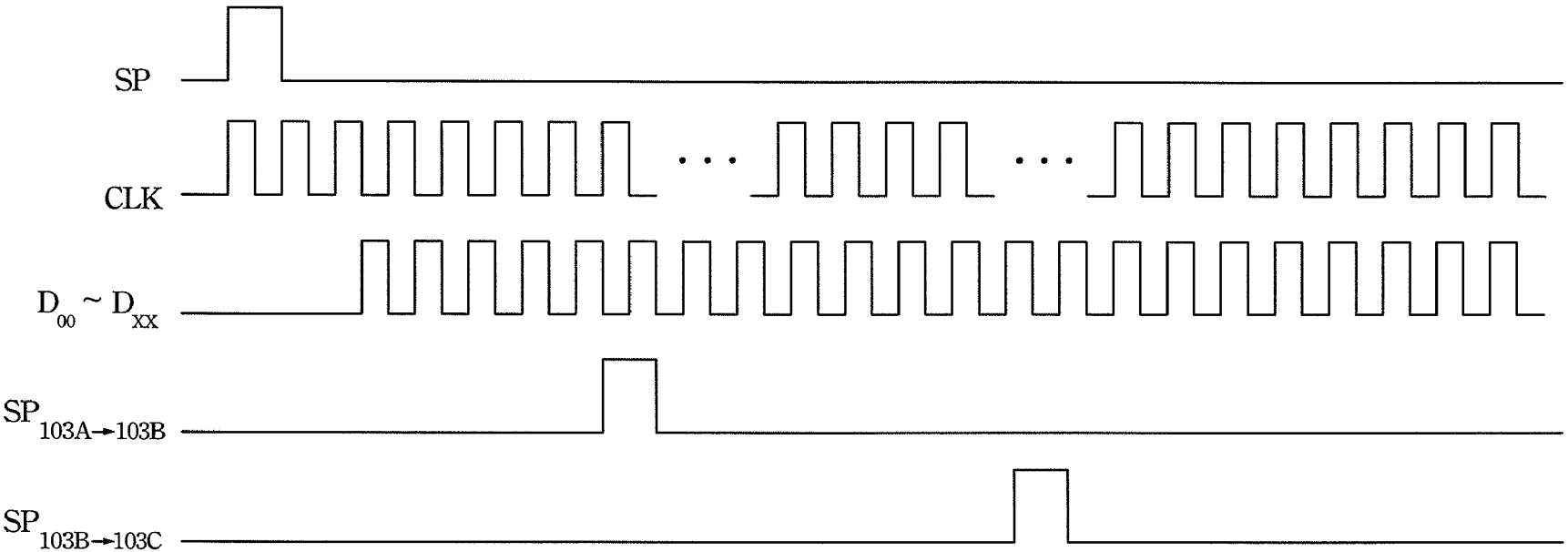
Fig. 2 (PRIOR ART)
FIG. 2 is a timing chart explaining operation of the flat panel display of FIG. 1.
Figure 3:
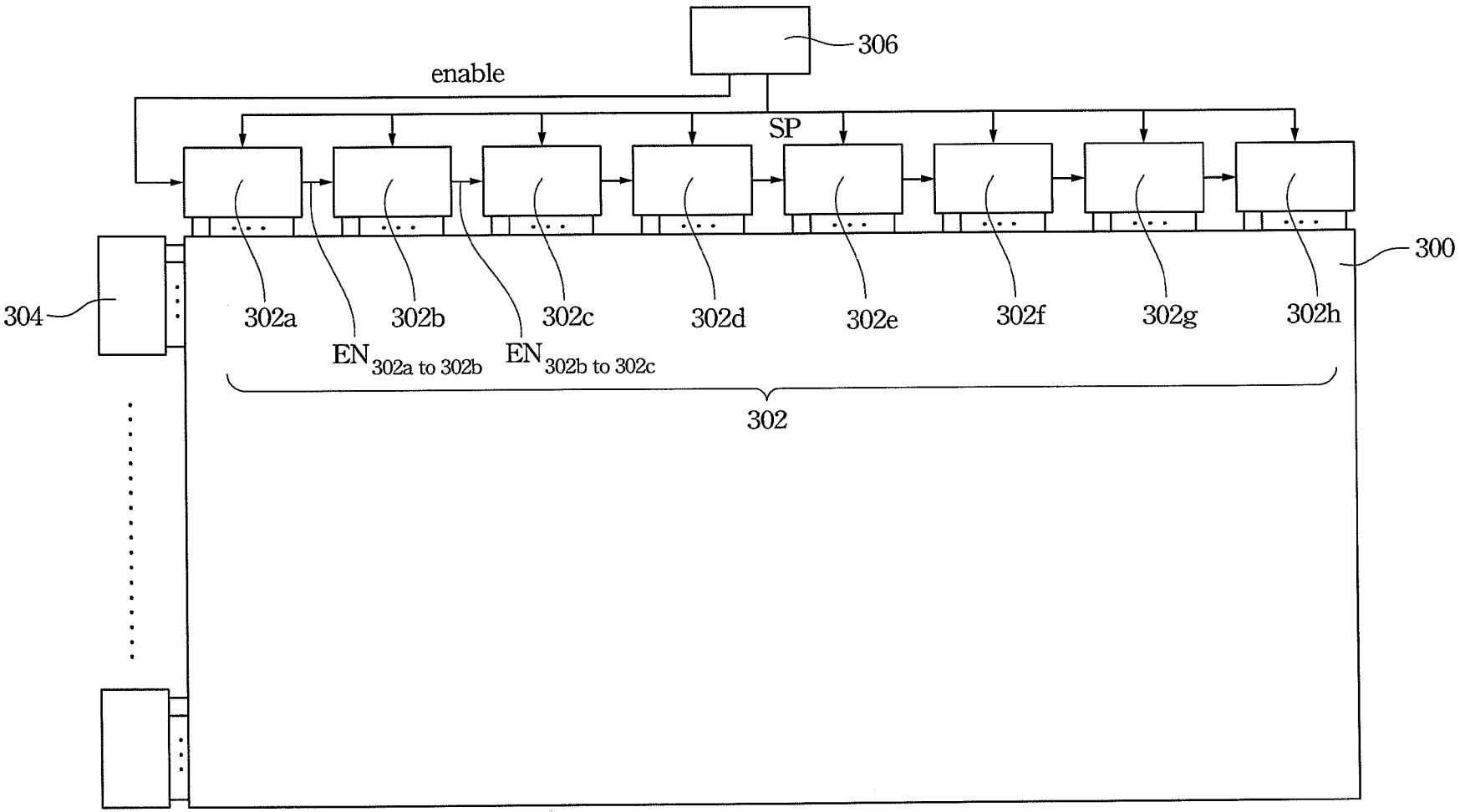
FIG. 3 is a schematic diagram of a plan view illustrating a flat panel display according to the preferred embodiment of the present invention.

The preferred embodiments of the present invention are explained below with reference to the accompanying drawings. FIG. 3 is a circuit diagram showing a drive circuit of a display unit according to the preferred embodiment of the invention. In the display panel 300, pixels are arranged in a matrix form while using a TFT as a switching device. A plurality of source drivers 302 are arranged along one end side in the direction of a row of the display panel 300. Eight source drivers 302*a* to 302*h* are used in this embodiment. In other embodiments, the number of source drivers 302 may be more or less than eight. The source drivers 302 are cascade-connected to each other. A plurality of gate drivers 306 are provided along one end side in the direction of a column of the display panel 300. On the other hand, a control circuit 306 is provided to generate start pulse signals (SP) to the source drivers 302 and an enabling signal (EN) that is transferred to the source drives 302 one by one. In addition, the controller circuit 306 also transfers clock signals to the source drivers 302. The enabling signal is a TTL signal. The start pulse signals are RSDS signals.

The start pulse signals (SP) generated by the control circuit 306 are provided to all the source drivers 302. However, the enabling signal (EN) is transmitted to only the first source driver 302*a* and is sequentially transmitted to the eighth source driver 302*h*. In response to the enabling signal (EN), the first source driver 302*a* start to receive the start pulse signals (SP) from the control circuit 306. In response to the start pulse signals (SP), the first source driver 302*a* start to receive an image signal from an image data processing device (not shown in this figure). The image signal is synchronized with the clock signal from the control circuit 306. After the first source driver 302*a* starts to receive the image data, the enabling signal (EN) is transmitted from the first source driver 302*a* to the second source driver 302*b*. In response to the enabling signal (EN), the second source driver 302*b* starts to receive the start pulse signals (SP) from the control circuit 306. In response to the start pulse signals (SP), the second source driver 302*b* start to receive an image signal from the image data processing device. After the second source driver 302*b* start to receive the image data, the enabling signal (EN) is transmitted from the second source driver 302*b* to the third source driver 302*c*. The rest may be deduced by analogy.

Figure 4:
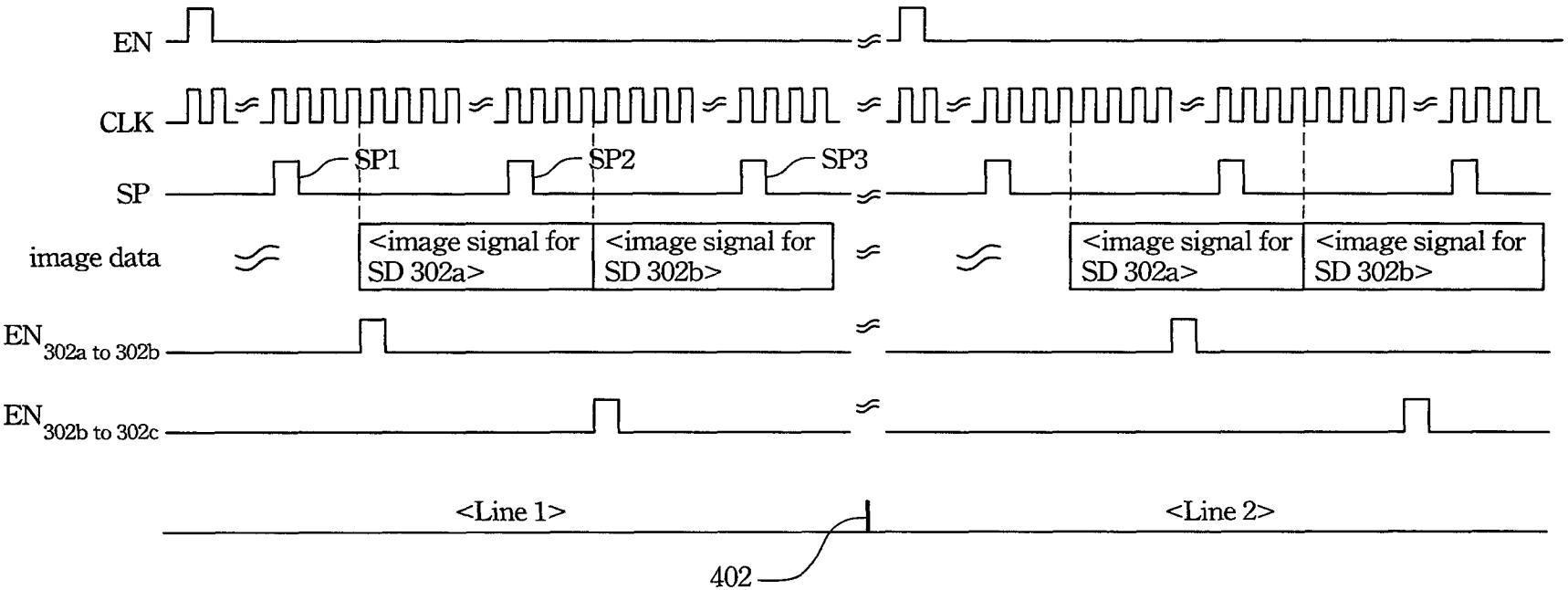
FIG. 4 is a timing chart explaining operation of the flat panel display of FIG. 3.

FIG. 4 is a timing chart showing the enabling signal (EN), clock signal (CLK), start pulse signal (SP) and image signal used in the drive circuit of FIG. 3.

In response to a synchronizing clock signal (CLK), an enabling signal (EN) and start pulse signals (SP) are generated by the control circuit 306. The enabling signal (EN) is a single pulse signal that has a pulse width equal to one period of the clock signal. The start pulse signals (SP) include a series of pulses, SP1, SP2, SP3 and so on, and their widths are also equal to one period of the clock signal. The number of the pulses of the start pulse signals is equal to the number of the source drivers 302. The start pulse signals (SP) are transmitted from the control circuit 306 to all the source drivers 302 at the same time. The enabling signal (EN) is transmitted to these source drivers 302 one by one.

When the first source driver 302*a* receives the enabling signal (EN), the first source driver 302*a* is enabled to receive the start pulse signal (SP1). In response to the start pulse signal (SP1), the first source driver 302*a* starts to receive the image data. The image signal is latched by the first source driver 302*a* based on the fourth falling edge of the clock signal (CLK). After the first source driver 302*a* starts to receive the image data, the enabling signal $EN_{302a\ to\ 302b}$, is transmitted from the first source driver 302*a* to the second source driver 302*b*. When the second source driver 302*b* receives the enabling signal $EN_{302a\ to\ 302b}$, the second source driver 302*b* is enabled to receive the start pulse signal (SP2). In response to the start pulse signal (SP2), the second source driver 302*b* starts to receive the image data. This image signal is latched by the second source driver 302*b* based on the fourth falling edge of the clock signal (CLK). After the second source driver 302*b* starts to receive the image data, the enabling signal $EN_{302b\ to\ 302c}$, is transmitted from the second source driver 302*b* to the third source driver 302*c*. The operation of the third source driver 302*c* is similar to that of the first or second source driver. When transmission of the image signals of one display line (Line 1) is finished, the control circuit 306 is reset by a reset signal 402. Then, an enabling signal (EN) and start pulse signals (SP) are generated again by the control circuit 306 to access the image signal of the next display line (Line 2).

Figure 5:
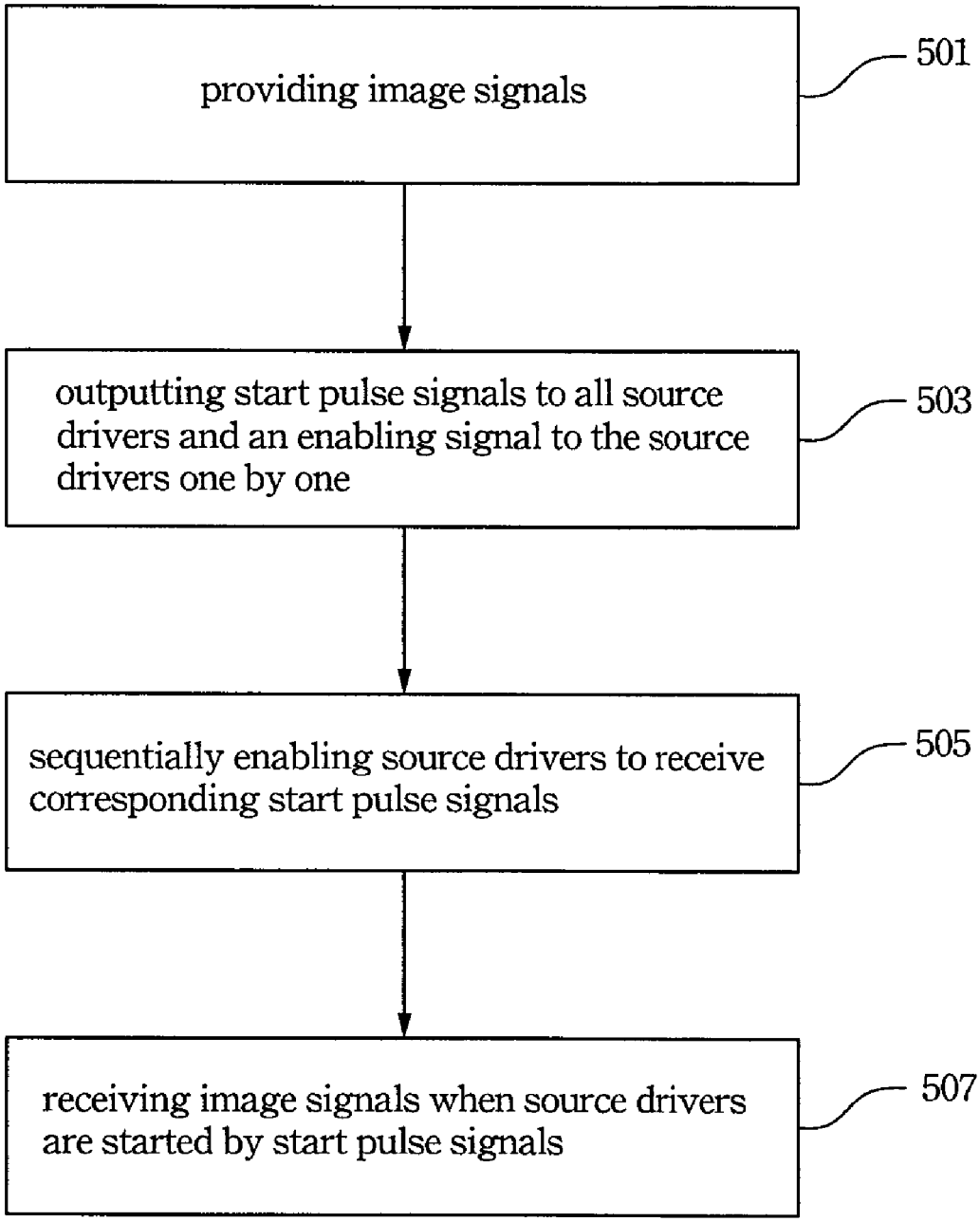
FIG. 5 is a flowchart for transmitting image data.

FIG. 5 is a flowchart for transmitting image data. In step 501, an image data processing device or the like (not shown in this figure) generates image signals. In step 503, in response to a synchronizing clock signal (CLK), the control circuit 306 generates an enabling signal (EN) and start pulse signals (SP). The start pulse signals (SP) are transmitted from the control circuit 306 to the all source drivers 302 at the same time. The enabling signal (EN) is transmitted to these source drivers 302 one by one. In step 505, the enabling signal (EN) sequentially enables these source drivers for receiving the start pulse signals. Finally, in step 507, when the source drivers 302 receive the start pulse signals (SP), in response to the start pulse signals (SP), the source drivers 302 start to receive the image data.

Accordingly, the start pulse signals are transmitted to the all source drivers at the same time. An additional enabling signal is issued to enable the source drivers to receive corresponding start pulse signals. Therefore, the source drivers may securely receiver the start pulse signals. The time between the input of the start pulse signals and the operation of the source drivers for receiving the image data may be reliably secured. Moreover, the only TTL signal is the enabling signal. However, no setup/hold time exists in the enabling signal. Therefore, in the high frequency application, the timing issue of the enabling signal may be released.

As is understood by a person skilled in the art, the foregoing descriptions of the preferred embodiments of the present invention are illustrations of the present invention rather than limitations thereof. Various modifications and similar arrangements are included within the spirit and scope of the appended claims. The scope of the claims should be accorded to the broadest interpretation so as to encompass all such modifications and similar structures. While preferred embodiments of the invention have been illustrated and described, it will be appreciated that various changes can be made therein without departing from the spirit and scope of the invention.

What is claimed is:

1. A liquid crystal display, comprising:

a display panel;

a plurality of gate drivers, for sequentially enabling rows of pixels of the display panel;

a plurality of source drivers, for outputting a plurality of driving signals to the enabled row of the pixels of the display panel; and a timing controller configured to output a clock signal to the source drivers and output each of a plurality of start pulses to all the source drivers and to sequentially enable the source drivers so that each source driver respectively receives a corresponding one of the start pulses, wherein each of the source drivers is configured to latch a plurality of image signals at the time of a fourth falling edge of the clock signal that is calculated from an instant of each of the source drivers receiving one of the start pulses.

2. The liquid crystal display according to claim 1, wherein each of the source drivers is enabled when receiving an enable signal.

3. The liquid crystal display according to claim 2, wherein the enable signal is transferred among the source drivers one by one.

4. The liquid crystal display according to claim 2, wherein the enable signal is a TTL signal.

5. The liquid crystal display according to claim 2, wherein a pulse width of the enable signal is equal to one period of the clock signal.

6. The liquid crystal display according to claim 2, wherein a pulse width of each of the start pulses is equal to one period of the clock signal.

7. The liquid crystal display according to claim 1, wherein each of the start pulses is an RSDS signal.

8. A method for delivering image signals to source drivers of a liquid crystal display, the method comprising the steps of:

outputting a clock signal to the source drivers;

outputting each of a plurality of start pulses to all the source drivers; and sequentially enabling the source drivers so that each source driver respectively receives one of the start pulses, wherein each of the source drivers latch the image signals at the time of a fourth falling edge of the clock signal that is calculated from an instant of each of the source drivers receiving one of the start pulses.

9. The method according to claim 8, wherein a TTL signal is used to enable the source drivers.

10. The method according to claim 8, wherein each of the start pulses is a RSDS signal.

11. A circuit for driving a display panel, comprising:

a plurality of source drivers configured to output driving signals to pixels of the display panel; and a timing controller configured to output a clock signal to the source drivers and output each of a plurality of start pulses to all the source drivers and to sequentially enable the source drivers so that each source driver respectively receives one of the start pulses, wherein each of the source drivers latch image signals at the time of a fourth falling edge of the clock signal that is calculated from an instant of each of the source drivers receiving one of the start pulses.

12. The circuit according to claim 11, wherein a TTL signal is used to enable the source drivers.

13. The circuit according to claim 11, wherein each of the start pulses is an RSDS signal.

14. A method for transmitting image signals in a liquid crystal display, the liquid crystal display comprising first and second source drivers, the method comprising the steps of:

providing a plurality of image signals;

providing a clock signal;

providing a start pulse signal;

providing a first enable signal to the first source driver; and receiving the image signals into the first source driver at the time of a fourth falling edge of the clock signal that is calculated from an instant of the first source driver receiving a pulse of the start pulse following the first enable signal.

15. The method according to claim 14, further comprising the steps of:

providing a second enable signal from the first source driver to the second source driver; and receiving the image signals into the second source driver in response to a pulse of the start pulse signal following the second enable signal.

16. The method according to claim 14, wherein the first enable signal is a TTL signal and the start pulse signal is a differential-pair signal.

17. The method according to claim 14, wherein the step of receiving the image signals is performed according to the clock signal.

18. The method according to claim 17, wherein the clock signal, the first enable signal, and the start pulse signal are provided by a timing controller.

19. A driving circuit, comprising:

a first input terminal, electrically coupled to an enable signal;

a second input terminal, electrically coupled to a start pulse signal;

a third input terminal electrically coupled to a clock signal; and means for receiving a plurality of image signals at the time of a fourth falling edge of the clock signal that is calculated from an instant of the receiving means receiving a pulse of the start pulse signal following the enable signal.

20. The driving circuit according to claim 19, wherein the enable signal is a TTL signal and the start pulse signal is a differential-pair signal.

21. A circuit for driving a display panel, comprising:

a timing controller, for providing a plurality image signals, a clock signal, a first enable signal and a start pulse signal; and first and second source drivers, for outputting a plurality of driving signals to corresponding pixels of the display panel according the image signals;

wherein the first source driver latches the image signals at the time of a fourth falling edge of the clock signal that is calculated from an instant of the first source driver receiving a pulse of the start pulse following the first enable signal, and the second source driver latches the image signals at the time of a fourth falling edge of the clock signal that is calculated from an instant of the second source driver receiving a pulse of the start pulse signal following a second enable signal from the first source driver.

* * * * *